US005372437A

United States Patent [19]

Michioto et al.

[11] Patent Number: 5,372,437

[45] Date of Patent: Dec. 13, 1994

[54] PRINT HEAD OF WIRE-DOT PRINTER AND PRODUCTION METHOD THEREOF

[75] Inventors: Takao Michioto, Hoya; Minoru Osawa, Sayama; Toshihiro Endo, Hoya, all of Japan

[73] Assignee: Citizen Watch Co., Ltd., Tokyo, Japan

[21] Appl. No.: 47,278

[22] Filed: Apr. 19, 1993

[30] Foreign Application Priority Data

Apr. 24, 1992 [JP] Japan ..... 4-106521

[51] Int. Cl.[5] ..... B41J 2/27

[52] U.S. Cl. ..... 400/124.17; 101/93.04; 101/93.29; 400/157.2; 335/279

[58] Field of Search ..... 101/93.04, 93.05, 93.29, 101/93.48; 400/121, 124, 157.2; 335/279, 281

[56] References Cited

U.S. PATENT DOCUMENTS 3,820,643 6/1974 Priebs et al. ..... 400/124
4,790,674 12/1988 Kleist et al. ..... 101/93.04
4,812,061 3/1989 Tsuyuki ..... 400/124

FOREIGN PATENT DOCUMENTS 57-62048 4/1982 Japan .
59-32433 2/1984 Japan .
59-98867 6/1984 Japan .

*Primary Examiner*—David A. Wiecking
*Attorney, Agent, or Firm*—Oliff & Berridge

[57] ABSTRACT

A print head of a wire-dot printer and a production method thereof, in which superhard chips are attached to contact surfaces of an armature and a core by brazing. The superhard chips can be readily secured to the contact surfaces of the armature and the core and are hardly worn by repeated impacts between the armature and the core which makes it possible to maintain the initial print quality for a long time and to obtain excellent abrasion resistance and strength of the contact surfaces in comparison with a conventional superhard film. It is not necessary to perform a grinding processing of the superhard chips with high accuracy after deposition thereof, and thus the thickness of the superhard chips can be readily controlled. As a result, production cost of the print head can be reduced.

22 Claims, 6 Drawing Sheets

| | ITEM / MATERIAL | HARDNESS | SPECIFIC GRAVITY | ANTI-REPULSION | TENSILE STRENGH | COMPRESSIVE STRENGH | YOUNG'S MODULUS | IMPACT VALUE | COMPOSITION |
|---|---|---|---|---|---|---|---|---|---|
| | | RA | g/cc | $kg/mm^2$ | $kg/mm^2$ | $kg/mm^2$ | $kg/mm^2$ | kg • m | % |
| | SUPER-HARD A | 91.5 | 14.00 | 230 | 110 | 530 | 62000 | 0.3 | WC • TaC – $Co^{10\%}$ |
| JIS | K20 | 91.0 | 14.80 | 195 | 110 | 570 | 62000 | 0.2 | WC – $Co^{6\%}$ |

Fig. 4

PRINT HEAD OF WIRE-DOT PRINTER AND PRODUCTION METHOD THEREOF

BACKGROUND OF THE INVENTION i) Field of the Invention

The present invention relates to a print head of a wire-dot impact printer having an armature with a print needle and a core for attracting the armature, and a production method of the print head.

ii) Description of the Related Arts

In general, in a conventional wire-dot impact printer, as shown in FIG. 1, a cantilever plate spring 1 having the functions of both an armature and an energizing spring is provided, and a print needle holder 2 and a print needle 36 are secured on the front surface of the free end of the cantilever plate spring 1. A core 5 wound with a coil 4 is arranged behind the cantilever plate spring 1 corresponding to the print needle holder 2.

In this structure, when a current supply to the coil 4 of the core 5 is switched on or off, by an attractive force between the core 5 and the cantilever plate spring 1 as the armature and a restorative force of the cantilever plate spring 1 as the energizing spring, the free end of the cantilever plate spring 1 is attracted to or repelled from the core 5. By utilizing tile reciprocal motion of the cantilever plate spring 1 due to the attraction and separation, dot printing can be carried out by the print needle 36.

In the print head of this kind, a contact surface 1*a* of the cantilever plate spring 1 at its free end is impacted with a contact surface 5*a* of the core 5 at a high speed, and thus both the contact surfaces 1*a* and 5*a* suffer considerable wear. Accordingly, in order to solve this problem, a conventional print head has been proposed, as disclosed in Japanese Patent Laid-Open No. Sho 59-98867. That is, in this case, superhard films 6 and 7 composed of non-magnetic tungsten carbide are deposited on both the contact surfaces 1*a* and 5*a* of the respective cantilever plate spring 1 and the core 5 by thermal spraying so as to perform an attraction control between the cantilever plate spring 1 and the core 5 (act as a magnetism killer) and to improve a wear resistance property of the contact surfaces.

This conventional print head will be described in detail in connection with FIG. 2.

In FIG. 2, the print head is provided with a non-magnetic frame 19 and a support 10 mounted to the frame 19, and on this support 10, one end of the cantilever plate spring 1 is supported via a spacer 21. On the front surface of the free end of the cantilever plate spring 1, an armature 22 composed of a cylindrical magnetic material is staked, and on this armature 22, the print needle holder 2 for holding the print needle 36 is attached.

On the frame 19, a first yoke 14 having the cylindrical core 5 composed of ferro silicon is also secured so that the tip surface of the core 5 may face the armature 22 with a slight gap with respect to the rear surface of the cantilever plate spring 1. The coil 4 is wound around the core 5 and is coupled with an electric circuit (not shown).

Further, on the first yoke 14, a mount plate 15 for mounting a permanent magnet 16 and a second yoke 17 are integrally mounted in stacked form. The superhard films 6 and 7 are formed on the contact surfaces 1*a* and 5*a* of the cantilever plate spring 1 and the core 5. For example, the superhard films 6 and 7 are formed as follows. First, a surface active treatment is applied to the contact surfaces 1*a* and 5*a* of the cantilever plate spring 1 and the core 5, and a superhard material such as non-magnetic tungsten carbide is deposited on the surface-treated contact surfaces by a detonation flame spraying method. Then, the superhard surfaces are ground to obtain a superhard film thickness of approximately 10 to 40 μm.

However, in the conventional print head, the particle size of the sprayed superhard material such as tungsten carbide of the superhard films 6 and 7 is large, such as 5 to 10 μm, and the density of the same is low. Hence, when the superhard film is formed of such a superhard material, the binding force for binding superhard particles with each other is weak and thus the superhard films 6 and 7 can be readily destructed by a repeated number of impacts between the cantilever plate spring 1 and the core 5. Hence, the degradation of the printing quality is quick. Also, the dispersion of the film quality is large and the performance of the print head is dispersed with the result of low reliability of the product.

With printing speed acceleration and printing density increase, the cantilever plate spring 1 and the core 5 are required to enable much more printing. However, this can not be achieved using the above-described conventional superhard films 6 and 7.

Further, in the above-described spraying method, the parts except the core 5 must be masked during the spraying operation. Also, after the deposition of the superhard films 6 and 7, the superhard films 6 and 7 are subjected to a high accuracy grinding process in order to obtain the desired film thickness to achieve optimum as the magnetism killer and desired abrasion resistance characteristics, and many production steps are required. At the same time, a large installation is required for the spraying method and thus the production cost for the print head becomes very high.

As described above, in the print head of the conventional wire-dot impact printer wherein the superhard films 6 and 7 are formed on the contact surfaces 1*a* and 5*a* of the cantilever plate spring 1 and the core 5 by the detonation flame spraying method, sufficient abrasion resistance of the contact surfaces 1*a* and 5*a* can not be obtained and the production cost is high.

SUMMARY OF THE INVENTION

It is therefore an object of the present invention to provide a print head of a wire-dot printer in view of the aforementioned problems of the prior art, which is capable of improving abrasion resistance and strength of an armature and a core and reducing production cost.

It is another object of the present invention to provide a production method for a print head of a wire-dot printer in view of the aforementioned problems of the prior art, which is capable of improving abrasion resistance and strength of an armature and a core and reducing production cost.

In order to achieve these objects, the print head of the wire-dot printer according to the present invention is characterized as follows.

(1) In a print head of a wire-dot printer, comprising a core wound with a coil; an armature which is biased by an energizing spring and is pivoted to be either attracted to or separated from the core by switching on or off a current applied to the coil so as to contact a contact surface of the armature with a contact surface of the core; and a print needle which is mounted to the armature and is to be moved backwards and forwards by the pivoting of the armature, a superhard chip being attached to at least the contact surface of the core.

(2) The superhard chip is secured to the contact surface of the core by a brazing material.

(3) In a production method for a print head of a wire-dot printer, the print head including a core wound with a coil; an armature which is biased by an energizing spring and is pivoted to be either attracted to or separated from the core by switching on or off a current applied to the coil so as to contact a contact surface of the armature with a contact surface of the core; and a print needle which is mounted to the armature and is to be moved backwards and forwards by the pivoting of the armature, a superhard chip whose entire surface is applied with a plating treatment being contacted to at least the contact surface of the core by brazing the plating material as a brazing material.

(4) The producing method further comprises a superhard chip formation step which includes at least cutting a rod-shaped superhard material into superhard pieces; grinding each superhard piece into a predetermined thickness; and carrying out the plating treatment over the entire surface of each ground superhard piece.

(5) The plating is an electroless nickel plating.

(6) The producing method further comprises fitting a cylindrical holder on the core; and brazing the superhard chip put on the contact surface of the core by using the cylindrical holder as a guide.

(7) The brazing is carried out at a speed of 21 cm/min at a temperature of 990° C.

(8) The thickness of the superhard chip attached to the core by the brazing material is at least 40 μm to at most 75 μm from the surface of the core.

(9) The thickness of the plating material formed over the entire surface of the superhard chip by the plate treatment is approximately 10 μm from the surface of the superhard chip.

(10) The superhard chip is a fine micrograin superhard material composed of fine micrograins having a particle size of at most 1 μm.

According to the present invention, in the print head of the wire-dot printer, the superhard chip attached to the contact surface of the core is hardly worn, and abrasion resistance and strength of the superhard chip are excellent in comparison with the conventional superhard film which makes it possible to maintain the initial print quality for a long time.

Further, by only brazing the superhard chip having the excellent abrasion resistance, formed in another process, the superhard chip can be attached to the contact surface of the core or the armature. Also, the thickness of the superhard chip can be previously formed to the predetermined value, and thus the specified thickness of the superhard chip can be easily realized. Hence, no grinding processing of the superhard chip after the deposition thereof is required.

BRIEF DESCRIPTION OF THE DRAWINGS

The objects, features and advantages of the present invention will become more apparent from the consideration of the following detailed description, taken in conjunction with the accompanying drawings, In which:

FIG. 4 is a diagram showing various properties of a material superhard A used for a superhard chip employed in a print head of a wire-dot printer according to the present invention;

DESCRIPTION OF THE PREFERRED EMBODIMENTS

Figure 1:
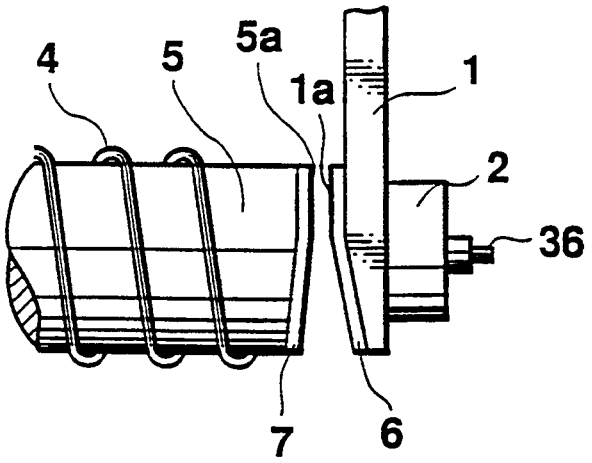
Fig. 1 PRIOR ART
FIG. 1 is an elevational view of an essential part of a print head of a conventional wire-dot printer.

The present invention will now be described in connection with its preferred embodiments with reference to the accompanying drawings, wherein like reference characters designate like or corresponding parts throughout the views and thus the repeated description thereof can be omitted for brevity.

Figure 3:
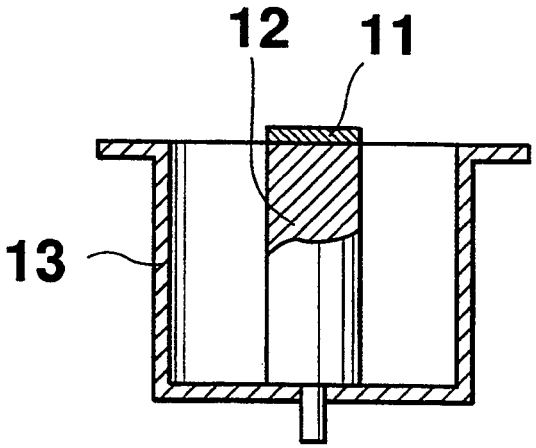
FIG. 3 is a cross sectional view of a core part of a print head of a wire-dot printer according to the present invention.

FIG. 3 shows a core part of a print head of a wire-dot printer according to the present invention. A core 12 is mounted to a shell 13 and a superhard chip 11 formed in a thin plate shape is attached to a contact surface of the core 12 by brazing so as to be contacted with an armature (not shown).

In this embodiment, a new superhard material such as superhard A is used as the superhard chip 11. As shown in FIG. 4, in comparison with a conventional superhard material such as K20, superhard A possesses certain properties, that is, although particles of tungsten carbide (WC) are fine micrograins with a particle size of at most 1 μm and have almost the same hardness, antirepulsion is large such as 230 kg/mm$^2$, it is hard to cause deficiency and its toughness is high. However, even in case of another superhard material, when the particles are fine micrograins with a particle size of at most 1 μm, its durability difference is slight and the essential effects are not changed. Hence, another superhard material can be used as the superhard chip 11.

Concerning the superhard chip 11, When the thickness is less than 35 μm, the necessary strength can not be obtained, and, when more than 60 μm, the superhard chip 11 cancels the magnetic field attractive force of the core 12 too much, which deteriorates the characteristics of the print head. Hence, its thickness is determined to be 35 to 60 μm.

Next, a production method for a print head of a wire-dot printer according to the present invention will be described.

First, separately from the production process of the print head, the superhard chip 11 is formed in another process as follows.

A rod-shaped superhard blank having a diameter of approximately 4 mm and a length of approximately 150 mm, formed by a sintering method or the like, is sliced by a diamond cutter to form superhard pieces having a thickness of approximately 0.25 to 0.3 mm. One side surface of the sliced superhard piece is lapped (polishing to high accuracy while an original shape is kept) so as to attain a thickness of 40 μm to obtain the superhard chip 11. Of course, the thickness of the superhard chip 11 can be freely controlled. Further, an electroless nickel plating is applied to the entire surface of the superhard chip 11 having the thickness of 40 μm.

Thus, by using the obtained superhard chip 11, the print head will be produced as follows.

Figure 6:
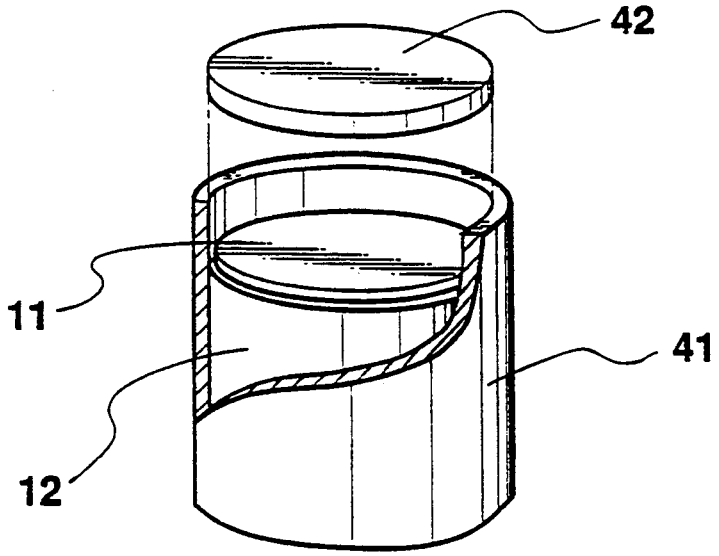
FIGS. 6*a* and 6*b* are perspective views of jigs for use in a brazing operation in the present invention.
Figure 6:
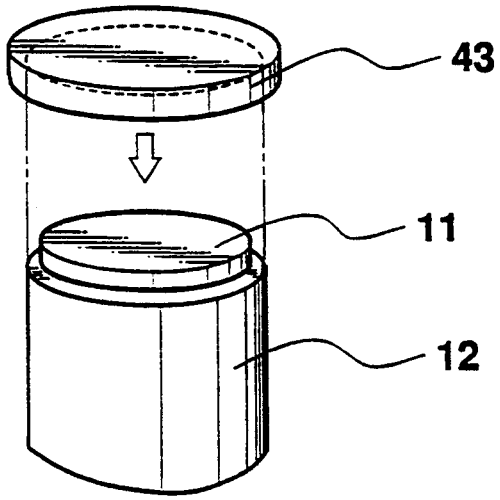
Figure 7:
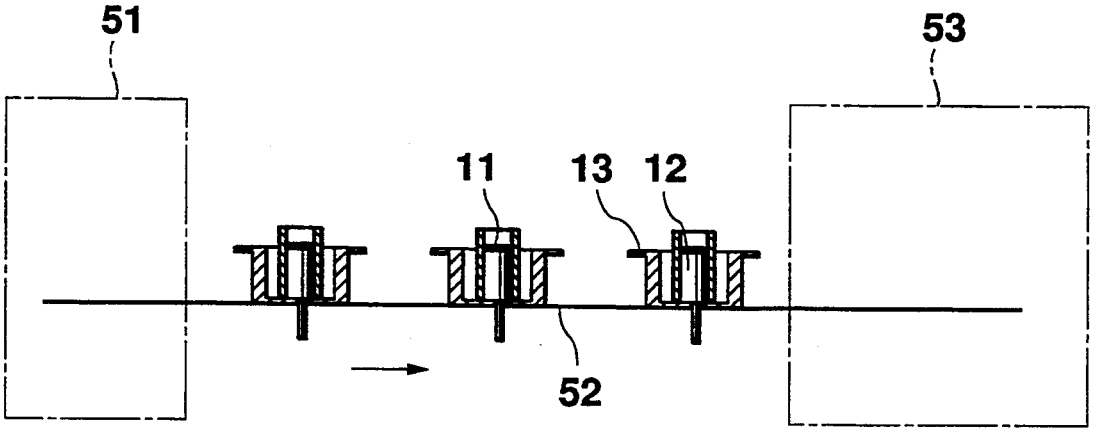
FIG. 7 is a schematic diagram showing a brazing process in the present invention.

First, the surface of the core 12 mounted on the shell 13 and the surface of the shell 13 are polished at the same time (the first polishing step). After finishing the first polishing step, a deburring of the polished parts is carried out. Next, as shown in FIG. 6*a*, a cylindrical holder 41 composed of ceramics or the like is fitted on the core 12, and the superhard chip 11 applied with the electroless nickel plating is placed on the contact surface of the core 12 with the assistance of the cylindrical holder 41 as a guide in a chip mount station 51 shown in FIG. 7. In this case, depending on the necessity, a weight 42 can be placed on the superhard chip 11.

In this state, the shell 13 is transferred from the chip mount station 51 to a continuous furnace 53 by using a conveyer 52, and the brazing of the shell 13 is executed at a temperature of 990° C. at a speed of 21 cm/min by using the nickel layer as a brazing material to secure the superhard chip 11 on the contact surface of the core 12. By this brazing processing, the brazing material on the contact surface side of the superhard chip 11 mainly flows out, and hence the thickness of the superhard chip 11 including the brazing material becomes approximately 40 μm to 70 μm by the time the brazing is finished.

Also, as shown in FIG. 6*b*, in another brazing method, a holder 43 having a cap shape can be placed on the core 12 from the top of the superhard chip 11 and the brazing can be carried out in the continuous furnace 53 in the same manner as described above.

In this case, the brazing material it is not restricted to nickel and, of course, other materials such as metals having a relative low melting point can be used.

As described above, in the conventional print head producing method in which the superhard films are formed by the spraying method, in addition to the above-described first polishing step, another polishing step of the superhard films is required and the masking must be applied at the parts other than the core at the time of spraying. On the other hand, in this embodiment, since the superhard chip 11 is formed in another process away from the print head producing process, the only polishing required in the print head producing process is the above-described first polishing step and the masking step is unnecessary. Further, the thickness of the superhard chip 11 can be controlled by the lapping and thus a step requiring a high accuracy operation for measuring the film thickness of the superhard film formed on the core surface after the polishing of the superhard film in the conventional method is not required.

Next, a more specific construction of a print head according to the present invention will be described in connection with FIG. 5.

Figure 5:
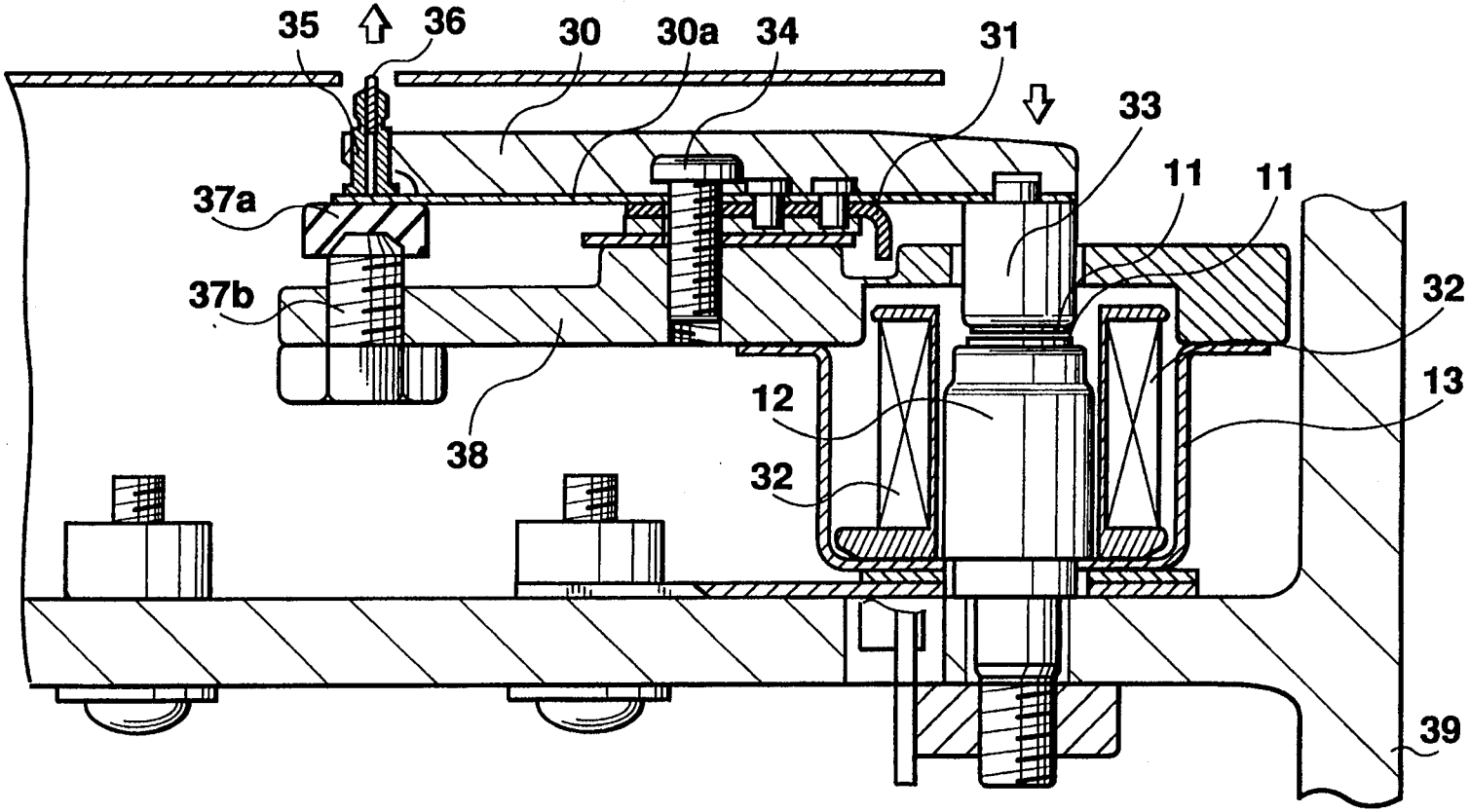
FIG. 5 is a cross sectional view of a print head of a wire-dot printer according to the present invention.

In FIG. 5, an armature 30 is provided so as to be biased in a counterclockwise direction in the figure around a support screw 34, which acts as a supporting point, by a plate spring 31. Also, the armature 30 is pivotally supported at roughly its central portion by the support screw 34. A print needle 36 is attached to one end of the armature 30 and a plunger 33 facing the core 12 of an electromagnetic actuator is provided in the other end of the armature 30. The superhard chips 11 are attached to the contact surfaces of the core 12 and the plunger 33 in the same manner as described above.

In the construction shown in FIG. 5, when no current is applied to a coil 32, by the force of the plate spring 31, an armature base 30*a* for holding a print holder 35 is contacted to a stopper 37*a* composed of rubber mounted to the tip of a stopper screw 37*b* and the print head is positioned in a print standby state. Next, when the current is applied to the coil 32 to actuate the core 12, the plunger 33 is attracted to the core 12 so that the armature 30 may pivot around the support screw 34 in the clockwise direction against the biasing force of the plate spring 31. By this pivot of the armature 30, the print needle 36 can press a printing paper (not shown) via an ink ribbon (not shown) to execute printing.

When the current applied to the coil 32 is stopped, the magnetic field of the core 12 disappears, and by the restorative force of the plate spring 31, the armature 30 is pivoted around the support screw 34 in the counterclockwise direction. Then, the armature base 30*a* is pushed onto the stopper 37*a* to stop the pivot of the armature 30 and the print head is returned to the print standby state.

In this case, as shown in FIG. 1, in the same manner as the conventional case, the print needle holder can be directly secured to the plate spring and the core is arranged on the rear side of the plate spring. Also, the print needle held by the print needle holder can be arranged on the front surface of the plate spring corresponding to the core.

In this embodiment, the superhard chips 11 attached to the contact surfaces of the core 12 and the plunger 33 act as the magnetism killer in the same manner as the conventional superhard films 6 and 7, that is, when the current applied to the coil 32 is stopped, the attractive force between the core 12 and the plunger 33 can be made to vanish in a short time to perform the role for finishing the printing.

Also, in FIG. 5, a stopper base 38 acts for mounting the stopper screw 37*b* and holding the plate spring 31 and performs a function as a spacer for keeping a predetermined distance between the armature 30 and the core 12.

In the above-described print head according to the present invention, the contact surfaces of the plunger 33 and the core 12 are impacted with each other at a high speed at the time of the attraction of tile plunger 33 to the core 12 and thus the contact surfaces of both the members are remarkably worn. By attaching the superhard chips 11 to the contact surfaces of the plunger 33 and the core 12 by the brazing, the wear resistance at the contact surfaces can be substantially improved.

Figure 2:
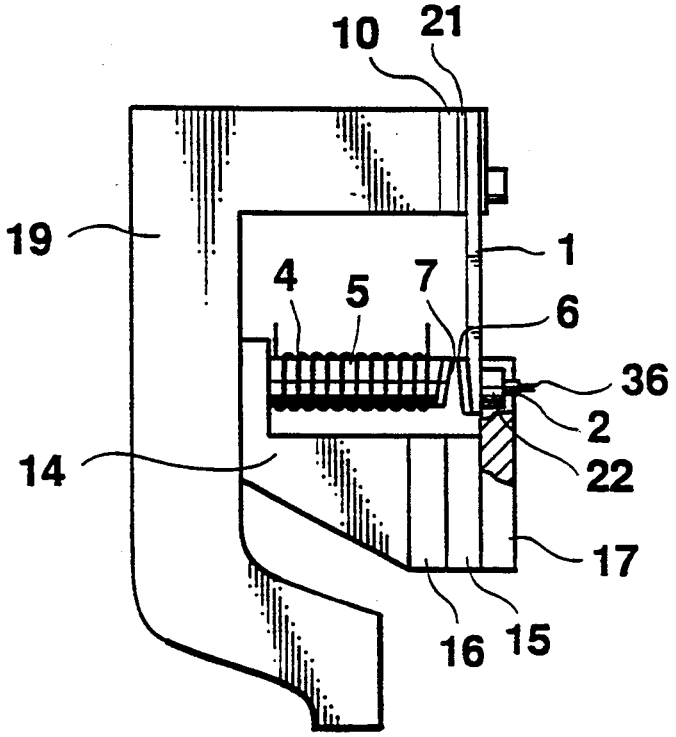
Fig. 2 PRIOR ART
FIG. 2 is an elevational view of the essential part of the print head shown in FIG. 1.

Further, in general, the present invention can be applicable to dot impact printers, that is, it can be used in both a serial type and a line type. Also, the present invention is not restricted to the above-described two attractive electromagnetic actuators and can be applied to an energy storage electromagnetic actuator wherein the armature is attracted by a permanent magnet in the print standby state shown in FIG. 2 and is separated by generating a reverse magnetic field by using a coil at the time of printing so as to pivot the armature.

As described above, in the print head of the wire-dot printer according to tile present invention, since the superhard chips attached to the contact surfaces of the core and the armature are hardly worn, the initial print quality can be maintained for a long time and the wear resistance and the strength can be remarkably improved compared with the conventional superhard films.

Further, the thickness control of the superhard chips can be readily carried out, and the polishing step with high accuracy after the formation of the superhard films, the masking step, the film thickness measuring step and the like in the conventional print head can be dispensed with. Hence, the production process and the Jigs can be simplified and thus a large cost reduction can be achieved in comparison with the conventional superhard film formation using the spraying process.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A print head of a wire-dot printer, comprising:
a core wound with a coil;
an armature biased by an energizing spring and pivotal to be either attracted to or repelled from the core by switching on or off a current applied to the coil so as to contact a contact surface of the armature with a contact surface of the core;
a print needle mounted on the armature and movable backwards and forwards by the pivoting of the armature; and
a superhard chip attached to at least one of the contact surface of the core and the contact surface of the armature, said superhard chip having predetermined dimensions prior to being attached to said at least one of said contact surfaces.

2. The print head of claim 1, further comprising a brazing material securing the superhard chip to at least one of the contact surface of the core and the contact surface of the armature.

3. The print head of claim 2, wherein the brazing material is nickel.

4. The print head of claim 1, wherein a thickness of the superhard chip prior to attachment is at least 35 μm to at most 60 μm from the surface of the core.

5. The print head of claim 2, wherein a thickness of the superhard chip prior to attachment by the brazing material is at least 40 μm to at most 75 μm from the surface of the core.

6. The print head of claim 2, wherein a thickness of a plating material formed over the entire surface of the superhard chip by a plating treatment is approximately 10 μm from the surface of the superhard chip.

7. The print head of claim 1, wherein the superhard chip is a fine micrograin superhard material composed of fine micrograins having a particle size of at most 1 μm.

8. The print head of claim 2, wherein the superhard chip is a fine micrograin superhard material composed of fine micrograins having a particle size of at most 1 μm.

9. The print head of claim 1, wherein said superhard chip is attached to the contact surface of said core.

10. The print head of claim 9, wherein a second superhard chip is attached to the contact surface of said armature.

11. A production method of a print head of a wire-dot printer, the print head including:
a core wound with a coil;
an armature biased by an energizing spring and pivotal to be either attracted to or repelled from the core by switching on or off a current applied to the coil so as to contact a contact surface of the armature with a contact surface of the core; and
a print needle mounted to the armature and movable backwards and forwards by the pivoting of the armature,
the production method comprising the steps of:
carrying out a plating treatment of an entire surface of a superhard chip using a plating material; and
after carrying out said plating attaching the plated superhard chip to at least one of the contact surface of the core and the contact surface of the armature by a brazing process, using the plating material as a brazing material.

12. The production method of claim 11, further comprising forming the superhard chip prior to said attachment step, said forming including at least the steps of:
cutting a rod-shaped superhard material into superhard pieces;
grinding each of said superhard pieces to a predetermined thickness; and
carrying out the plating treatment over the entire surface of each of said ground superhard pieces, wherein each of said pieces forms a separate superhard chip.

13. The production method of claim 11, wherein the plating material is an electroless nickel plating.

14. The production method of claim 12, wherein the plating material is an electroless nickel plating.

15. The production method of claim 11, further comprising the steps of:
fitting a cylindrical holder on the core; and
brazing the superhard chips placed on the contact surface of the core using the cylindrical holder as a guide.

16. The production method of claim 13, further comprising the steps of:
fitting a cylindrical holder on the core; and
brazing the superhard chip placed on the contact surface of the core using the cylindrical holder as a guide.

17. The production method of claim 11, wherein the brazing process is carried out at a speed of 21 cm/min at a temperature of 990° C.

18. The production method of claim 13, wherein the brazing process is carried out at a speed of 21 cm/min at a temperature of 990° C.

19. The production method of claim 16, wherein the brazing process is carried out at a speed of 21 cm/min at a temperature of 990° C.

20. The production method of claim 12, wherein a thickness of the plating material formed over the entire surface of the superhard chip by the plating treatment is approximately 10 μm from the surface of the superhard chip.

21. The print head of claim 11, wherein the superhard chip is a fine micrograin superhard material composed of fine micrograins having a particle size of at most 1 μm.

22. The print head of claim 12, wherein the superhard chip is a fine micrograin superhard material composed of fine micrograins having a particle size of at most 1 μm.

* * * * *